US011851827B2

(12) United States Patent
Sick et al.

(10) Patent No.: US 11,851,827 B2
(45) Date of Patent: Dec. 26, 2023

(54) COMPOSTABLE TURF WITH DECOMPOSITION INHIBITOR

(71) Applicants: Polytex Sportbelage Produktions-GmbH, Grefrath (DE); TECHNOLOGY LICENSING CORPORATION, Cincinnati, OH (US); STADIA TURF TECHNOLOGY PTE. LTD., Singapore (SG)

(72) Inventors: Stephan Sick, Willich-Neersen (DE); Mark A. Heinlein, Cincinnati, OH (US); Ivo Lohr, Kempen (DE); Stefan Hally, Nettetal (DE); Hamish Sutherland, Romsey (AU)

(73) Assignees: Technology Licensing Corporation, Cincinnati, OH (US); Stadia Turf Technology Pte. Ltd., Singapore (SG); Polytex Sportbelage Produktions-GmbH, Grefrath (DE)

( * ) Notice: Subject to any disclaimer, the term of this patent is extended or adjusted under 35 U.S.C. 154(b) by 288 days.

(21) Appl. No.: 16/652,158

(22) PCT Filed: Oct. 5, 2018

(86) PCT No.: PCT/EP2018/077194
§ 371 (c)(1),
(2) Date: Mar. 30, 2020

(87) PCT Pub. No.: WO2019/068897
PCT Pub. Date: Apr. 11, 2019

(65) Prior Publication Data

US 2020/0248412 A1 Aug. 6, 2020

Related U.S. Application Data

(60) Provisional application No. 62/569,098, filed on Oct. 6, 2017.

(30) Foreign Application Priority Data

Nov. 22, 2017 (EP) ..... 17203097

(51) Int. Cl.
*E01C 13/08* (2006.01)

(52) U.S. Cl.
CPC ..... *E01C 13/08* (2013.01); *E01C 2013/086* (2013.01)

(58) Field of Classification Search
CPC .. E01C 13/08; E01C 2013/086; E01C 13/083; D10B 2505/202
See application file for complete search history.

(56) References Cited

U.S. PATENT DOCUMENTS 5,139,949 A 8/1992 Matsuda et al.
6,035,577 A 3/2000 Motz et al.
(Continued)

FOREIGN PATENT DOCUMENTS

DE 10063949 A1 6/2002
DE 102015113210 A1 2/2017
(Continued)

OTHER PUBLICATIONS

Machine translation of foreign reference DE102015113210 obtained from https://translationportal.epo.org/emtp/translate/?ACTION=description-retrieval&COUNTRY=DE&ENGINE=google&FORMAT=docdb&KIND=A1&LOCALE=en_EP&NUMBER=102015113210&SRCLANG=de&TRGLANG=en (last accessed on May 9, 2022) (Year: 2022).*

(Continued)

*Primary Examiner* — Theodore V Adamos
(74) *Attorney, Agent, or Firm* — Harness, Dickey & Pierce, P.L.C.

(57) ABSTRACT

The invention relates to a completely or partially compostable turf (202, 300) the turf being a completely or
(Continued)

partially compostable artificial turf or a hybrid turf (202) comprising a completely or partially compostable hybrid turf support, the turf comprising a decomposition inhibitor, the decomposition inhibitor in the turf being adapted to lose its functionality or leave the turf until a defined period of time has elapsed.

18 Claims, 2 Drawing Sheets

(56) References Cited

U.S. PATENT DOCUMENTS 6,145,248 A * 11/2000 Bergevin ..... A63C 19/04 47/65.5
6,691,455 B1 * 2/2004 Bergevin ..... E01C 13/083 428/17
8,445,252 B2 * 5/2013 Nakasaki ..... C12P 39/00 435/243
9,540,777 B1 1/2017 Tetrault
2010/0009100 A1 1/2010 Van Reijen
2010/0173102 A1 * 7/2010 Van Reijen ..... D06M 15/05 428/17
2012/0094107 A1 * 4/2012 Spittle ..... E01C 13/08 428/304.4
2012/0258811 A1 * 10/2012 Tetrault ..... C08J 3/24 252/78.3
2013/0027625 A1 1/2013 Lee et al.
2013/0034671 A1 * 2/2013 George ..... D01F 1/106 428/17
2013/0092281 A1 * 4/2013 Sutton ..... D03D 13/004 139/384 R
2014/0050866 A1 * 2/2014 Ejtaszewski ..... E01C 13/08 428/17
2015/0033626 A1 2/2015 Sutherland et al.
2016/0186387 A1 * 6/2016 McAnany ..... E01C 13/08 264/35
2016/0271285 A1 * 9/2016 Weller ..... A61L 2/10
2017/0081808 A1 * 3/2017 Lee ..... B32B 3/266
2017/0175343 A1 * 6/2017 des Garennes ..... E01C 13/08
2020/0121816 A1 * 4/2020 Grossman ..... A01G 20/30

FOREIGN PATENT DOCUMENTS

JP 2000239923 A * 9/2000
KR 100833584 B1 5/2008
KR 101009390 B1 1/2011
KR 101855284 B1 * 5/2018
WO WO-2007/114686 A1 10/2007
WO WO-2007114686 A1 * 10/2007 ..... D01F 6/92
WO WO-2022248440 A1 * 12/2022

OTHER PUBLICATIONS

International Search Report PCT/ISA/210 for International Application No. PCT/EP2018/077194 dated Apr. 16, 2020.
Written Opinion of the International Searching Authority PCT/ISA/237 for International Application No. PCT/EP2018/077194 dated Apr. 16, 2020.
International Search Report PCT/ISA/210 for International Application No. PCT/EP2018/077194 dated Mar. 19, 2019.
Written Opinion of the International Searching Authority PCT/ISA/237 for International Application No. PCT/EP2018/077194 dated Mar. 19, 2019.
Annex to Form PCT/ISA/206 Communication Relating to the Results of the Partial International Search for International Application No. PCT/EP2018/077194 dated Dec. 21, 2018.

* cited by examiner

COMPOSTABLE TURF WITH DECOMPOSITION INHIBITOR

CROSS-REFERENCE TO RELATED APPLICATIONS

This application is a national phase under 35 U.S.C. § 371 of PCT International Application No. PCT/EP2018/077194 which has an International filing date of Oct. 5, 2018, which claims priority to European Application No. 17203097.5, filed Nov. 22, 2017 and claims benefit to U.S. Application No. 62/569,098, filed Oct. 6, 2017, the entire contents of each of which are hereby incorporated by reference.

FIELD OF THE INVENTION

This invention relates to hybrid turf and artificial turf; more specifically, to the composting of hybrid turf and artificial turf.

BACKGROUND AND RELATED ART

Yarns for artificial turf and hybrid turf are commonly made of synthetic material, such as nylon, polyester or polyolefins. When the typical life span of hybrid or artificial turf ends, the worn turfs need to be disposed of correctly. As most of the synthetic materials used for artificial turf production are not biodegradable, the correct disposal of old artificial lawns may involve additional cost and may generate an undesired amount of waste.

In some venues, for example multi-purpose venues, which have a soccer season and thereafter a concert season, a newly installed hybrid turf for the soccer season may have to be replaced after the concert season with a new hybrid turf for the new soccer season (e.g., a replacement every twelve months). Each time a new hybrid turf is to be installed at a use site, for example, the synthetic components of the old, worn hybrid turf need to be removed from the ground before the new hybrid turf can be installed. The removal of worn hybrid turf may not be easy, as the hybrid turf is often strongly interconnected with the roots of the natural grass plants. The disposal of the worn hybrid turf is therefore problematic, because the mixture of natural grass, soil and synthetic materials is classified as land-fill waste, rather than organic waste, and is not recycled, and therefore expensive to dispose of.

Likewise, the replacing of artificial turf may in some cases damage the base layer, for example, in the case where the artificial turf was firmly glued to the base layer, such as a polyurethane base layer, which may be partially removed together with the old turf.

Therefore, a growing number of hybrid turf and artificial turf manufacturers have started replacing conventional fiber and carrier materials with materials that are biodegradable. For example, international patent application WO 2007/114686 describes the use of biodegradable synthetic fibers made of starch and polylactic acid.

However, biodegradation is a process that depends on a plurality of environmental factors, and the actual life expectancy of a biodegradable artificial or hybrid turf cannot, therefore, be predicted exactly.

In case biodegradation happens faster than expected, some types of biodegradable artificial turf or hybrid turf may deteriorate and decay while in use, resulting in poor playing performance of the turf, a reduced life expectancy of the turf, and the need to replace the turf more frequently. Faster than expected biodegradation of hybrid turf may also deteriorate and decay the hybrid turf before it is used in a sports field, for example where the hybrid turf is prepared and grown offsite on a turf farm, but deteriorates and decays before it can be successfully harvested into a roll of turf, transported, and subsequently laid in a sports field as ready to play hybrid turf.

On the other hand, some types of biodegradable artificial or hybrid turfs may, in some cases, biodegrade slower than expected. In this case, the disposing of worn turf may consume more space at a composting facility than expected and increase disposal costs. Furthermore, a slower biodegrading hybrid turf may be undesirable for the playing performance of a golf green. In this example, the hybrid turf is prepared and grown offsite at a turf nursery, and then used to create (support) a roll of turf, which would otherwise have had to rely on thatch and biomass to create (support) a roll of turf. The roll of hybrid turf is then relocated from the turf nursery to the golf green, and with its reduced thatch and biomass, it provides a firm and consistent green for ball pitch and roll. However, shortly after the installation of the hybrid turf, it is desirable for the fiber and carrier materials in the hybrid turf to biodegrade, otherwise they may adversely influence the playing performance within the golf green, or the playing performance compared between golf greens. Such a hybrid turf would typically have a useful life of six months, that is from the date of planting at the turf nursery.

DE102015113210 A1 describes a base layer for lawns which contains reinforcing fibers made of synthetic material. The reinforcement fibers are essentially non-biodegradable under the environmental conditions prevailing in the soil when used as a base layer. The biological degradation is initiated by activation of the base layer.

DE 10063949 A1 describes a process for the degradation of biodegradable polymers in which the degradation is carried out by adding above-ground growing plant parts.

U.S. Ser. No. 00/954,0777B1 describes a method of making synthetic turf infill materials wherein the surfaces of the materials have been modified with hydrophilic properties. The method comprises modifying the surface of synthetic turf infill through coating, crosslinking or other methods. The surface of the infill is modified to become substantially hydrophilic with low contact angles.

SUMMARY

It is an objective of the present invention to provide an improved method for controlling the decomposition of artificial or hybrid turf and a corresponding artificial or hybrid turf as specified in the independent claims. Embodiments of the invention are given in the dependent claims. Embodiments of the present invention can be freely combined with each other if they are not mutually exclusive.

In one aspect, the invention relates to a method of controlling the decomposition of artificial or hybrid turf. The method comprises providing a completely or partially compostable turf, the turf being a completely or partially compostable artificial turf or a hybrid turf comprising a completely or partially compostable hybrid turf support. The turf comprises a decomposition inhibitor. The decomposition inhibitor in the turf is adapted to lose its decomposition-inhibiting functionality or leave the turf until a defined period of time has elapsed. First of all, the use of decomposition inhibitors in a completely or partially compostable turf appears to be self-contradictory. However, it has been observed that by adding a particular amount of a decomposition inhibitor of a particular type to compostable turf, a better control of the decomposition process may be gained, thereby making the use of compostable turf more robust against various environmental factors such as temperature, rain, type of base material, and the like. Moreover, by choosing the appropriate amount and type of the decomposition inhibitor, it may be possible to produce different types of artificial or hybrid turf for different uses that have strongly different requirements with respect to the life expectancy of the turf. Thereby, the turf is robust against decay before the expected end of its service life and is ensured to decay rapidly (i.e., be "compostable") as soon as the life expectancy of the turf ends, or as soon as a user, after the life expectancy has ended, adds a decomposition booster to the turf.

The provision of the turf with the decomposition inhibitor can comprise, for example, installing an artificial or hybrid turf whose synthetic components (e.g. the fibers, the backing and/or the carrier material) already comprise the decomposition inhibitor. Preferably, the decomposition inhibitor is homogeneously distributed in the respective material of the synthetic turf component. Alternatively, or in addition, the provision of the turf with the decomposition inhibitor can comprise applying the decomposition inhibitor on an already installed artificial or hybrid turf. The synthetic components of the already installed turf may or may not comprise a decomposition inhibitor. The inhibitor can be applied, for instance, via the water used for irrigating the artificial or hybrid turf. Alternatively, the inhibitor can be applied as a separate liquid solution or as a powder comprising the decomposition inhibitor.

According to embodiments, the elapsed period of time is measured starting from the installation of the artificial or hybrid turf at the use site ("onsite"). According to other embodiments, the elapsed period of time is measured starting from the installation of the hybrid turf structure at the turf farm (offsite).

Preferably, the use site comprises some base material, such as concrete, sand or soil. Preferably, the turf is installed on top of a water-permeable layer, e.g. a layer of sand (typical granule size: 0.1-2 mm), aggregate or other form of matter that, like sand, has a similarly low capacity to retain moisture and water. This may be advantageous, as sand and aggregate typically do not contain many soil bacteria or bacteria that digest turf fibers and other turf components. Moreover, sand and aggregate typically are relatively dry and chemically inert. Thus, the life expectancy of turf installed on top of a layer of sand or aggregate may be particularly high, and premature decay of the turf may be inhibited. In some embodiments, hybrid turf is installed on top of a layer of sand while artificial turf is installed on top of a layer of aggregate.

According to embodiments, the method comprises exposing the turf to water repeatedly until the defined period of time has elapsed.

According to embodiments, the method further comprises adding a decomposition booster other than water to the turf. The decomposition booster is adapted to compost the turf.

This may be advantageous, as an additional decomposition booster other than water is used to trigger the start of the composting process. Typically, hybrid turf, but also artificial turf, is repeatedly in contact with water, for example, with rainwater or with water delivered by an irrigation system. In conventional biodegradable turf systems, the contact with water may already be sufficient to trigger biodegradation. In effect, the duration of the composting process may strongly depend on the frequency and duration of rain and irrigation periods and thus may be hard to predict and control. To the contrary, by adding a specific decomposition booster other than water, embodiments of the invention may allow the owner or operator of a use site where the turf is installed to gain better control of the start and duration of the composting process.

According to embodiments, the decomposition booster is added in temporal proximity to the time when the defined period of time has elapsed, preferably within two weeks before and two weeks after the time when the defined period of time has elapsed. This may provide for a fine grained, tight control of the time when the composting process starts.

According to embodiments, the method further comprises dividing the turf into pieces. Preferably, this step is performed in temporal proximity to the time when the defined period of time has elapsed. For example, division can be performed when the defined period of time has elapsed or some days or 1-2 weeks before or after the defined period of time has elapsed. According to one example, the operator of a worn artificial turf or worn hybrid turf may use a type of chaffing, milling, beating or cutting machine for dividing (e.g. chopping, cutting, milling, breaking, etc.) the fibers and the carrier layer and backing, if any, of the artificial or hybrid turf into small pieces of, for example, several centimeters. The pieces of the artificial or hybrid turf generated by this process are then ploughed, mixed or incorporated into the immediate base beneath. Thus, a mixture of turf pieces and the base material below, typically sand or aggregate, is created. This mixture may also stabilize and reinforce the base material below, which may be desirable for load bearing, for example concert stages on a playing field. Dividing the worn turf into pieces may also have the advantage that it can be easily collected and transported to a remote composting facility.

According to embodiments, the adding of the decomposition booster, if any, comprises mixing the decomposition booster with the turf pieces or applying the decomposition booster on the turf before it is divided.

This may be advantageous, as the decomposition booster may be homogeneously mixed with the turf pieces, thereby ensuring that the decomposition booster contacts all sides of the turf pieces. For example, the pieces of the artificial or hybrid turf generated by the division process can be mixed with a plough, rotary hoe or similar, into the base layer together with the decomposition booster or mixed with a new imported base layer with the decomposition booster. Alternatively, the pieces of turf can be transported from the use site to a composting facility, whereby the turf pieces are mixed with the decomposition booster (e.g., soil, or isolated soil bacteria and/or even isolated enzymes). Still alternatively, the decomposition booster, e.g. enzymes or soil bacteria, can be added and distributed homogeneously on the turf shortly (e.g. some hours or some days) before the turf is divided into pieces. Thus, by adding a decomposition booster to the chopped pieces of the turf, embodiments of the invention may allow composting of the turf to be initiated at a defined start time and for a defined duration until the turf is composted. The pieces of the artificial or hybrid turf generated by the division process are then mixed within.

According to embodiments, the turf comprises artificial turf fibers that comprise or consist of polylactic acid (PLA).

Using PLA may have the advantage that PLA fibers are comparatively robust and cheap. They are susceptible to biodegradation, at least after being in contact with a decomposition booster (that may be added automatically, semi-automatically or manually). A further benefit of using PLA fibers may be that the composting time can be predicted more accurately than, for example, that of several naturally occurring fibers having heterogeneous properties and thus also a diverse susceptibility for biodegradation.

PLA is a biodegradable and bioactive thermoplastic aliphatic polyester derived from renewable resources, such as corn starch (in the United States and Canada), tapioca roots, chips, or starch (mostly in Asia), or sugarcane (in the rest of the world).

According to embodiments, the turf comprises a compostable carrier mesh made of plant fibers, such as sisal, jute, linen, coconut, or hemp. Said features may be advantageous, as the plant fibers are comparatively cheap and are made of renewable sources.

Thus, the use of synthetic fibers that are typically made from crude oil products whose long-term availability is limited in an artificial lawn production may be avoided. This may be advantageous in view of the expected depletion of oil reserves in a few decades.

According to embodiments, the artificial or hybrid turf is completely or at least partially made of biodegradable material. By using a biodegradable material as the raw material, the fibers thus obtained can be produced in large amounts, and the turf can be broken down over time without causing environmental pollution and contamination, unlike crude oil-based synthetic artificial or hybrid turfs, which remain present permanently after use, and thus burden the environment to a significant degree.

According to embodiments, the artificial or hybrid turf is completely or at least partially made of a renewable ("bio-based") material. This may be advantageous, as the turf is derived from a biological natural product whose availability is also guaranteed in the future.

In some embodiments, the plant fibers or other forms of compostable fibers do not only constitute a carrier mesh into which the fibers are incorporated in a later step, but they also provide the artificial fibers for the artificial turf or hybrid turf. For example, the fibers can be interwoven to form a mesh from which the fibers extend to one side. This represents the upper side of the artificial or hybrid grass.

According to embodiments, the turf comprises a backing of natural latex or starch-based latex. Preferably, the backing is compostable after the decomposition inhibitor has lost its function or has left the turf, but not before.

According to embodiments, the turf is completely compostable in response to the adding of the decomposition booster, but is not compostable without the presence of the decomposition booster.

According to embodiments, the decomposition booster comprises an acidic solution having a pH value below 6, more preferentially below 4.5. In some example implementations, pH values below 3 are used. For example, after the defined time has elapsed, an operator of the facility where the turf is installed may add formic acid or acetic acid to water to create an acidic solution whose pH is low enough to dissolve or weaken acid sensitive material such as agar-agar or PLA. PLA can degrade via the acid-catalyzed hydrolysis of the ester bonds within it and the gel-strength of agar-agar has been observed to weaken as the pH decreases. Thus, the degradation of artificial turf fibers made of PLA and/or a backing material made of agar-agar can be triggered and accelerated by applying water with low pH on the artificial turf or hybrid turf at the use site or at a dumping ground for compostable material. For example, the acidic solution can be applied manually or via an automated irrigation system.

According to some example embodiments, the composting of the turf is triggered by adding a decomposition booster that is or comprises an acid solution or a basic solution (e.g., a diluted acetic acid, or HCl). Solutions with an acidic or basic pH value, in particular pH values below 6.0 and above 8.0, may trigger the composting of the turf or its components by dissolving the fibers or other material, or by inducing microcracks in the fibers, which allows soil bacteria to enter the material.

Applying an acidic solution may have the advantage that some materials, including plant fibers, are destroyed or become weakened by the low pH value. As a consequence, bacteria or enzymes may easily penetrate the fibers and other components of the artificial or hybrid turf, and the time needed for the biodegradation and composting process may be significantly reduced.

According to embodiments, the decomposition booster comprises soil. The soil will comprise various strains of soil bacteria capable of biodegrading and composting the turf. For example, the soil may be added to the artificial or hybrid turf or to pieces of the artificial or hybrid turf by, for example, filling a soil layer on top of the turf. Then, the soil layer, the turf layer, and some parts of a sand or aggregate layer constituting the base material are mixed together, by a plough rotary-hoe or similar. Preferably, the soil is added to an amount that, when mixed with the turf and the base layer, a mixture comprising the soil component in at least 10% by its weight, more preferably in at least 20%, and even more preferably in at least 50% by its weight, is generated. This may be advantageous, as soil is comparatively cheap and abundantly available.

According to other embodiments, the soil is added to pieces of the turf at a dumping ground for compostable material. The turf is deinstalled, shredded and the resulting turf pieces are mixed with soil at the dumping ground such that a turf-soil mixture comprising the soil component in at least 10% by its weight, more preferably in at least 20%, and even more preferably in at least 50% by its weight, is generated.

According to other embodiments, the decomposition booster comprises one or more strains of isolated soil bacteria. For example, the soil bacteria can be bacterial strains that have been isolated from compost. Preferably, the bacterial strains comprise hydrocarbon-degrading bacteria. The isolated soil bacteria are preferably one or more bacterial strains selected from a group comprising *Pseudomonas* sp., *Mucobacterium* sp., *Corynebacterium* sp., *Aeromonas* sp., *Rhodococcus* sp., and *Bacillus* sp. Using isolated bacterial strains for boosting the composting of turf may have the advantage that an ever-more-accurate and fine-granular control of the composting process may be supported. While the bacterial strain composition in natural soil may vary, the use of one or more isolated bacterial strains may ensure reproducible composting conditions and thus a more accurate prediction of the time actually required for composting a particular type of turf.

Using a mixture of multiple bacterial strains or using the bacteria already present in soil may be advantageous, as a single bacterial strain may not possess all enzymes necessary to degrade all or even most of the organic compounds in the turf. Mixed microbial communities have a powerful biodegenerative potential because the genetic information of more than one organism is necessary to degrade the complex mixtures of organic compounds present in hybrid or artificial turf, which may comprise many different substances (e.g., substances contained in the plant fibers, PLA, and natural rubber).

According to embodiments, the decomposition booster comprises enzymes adapted for biodegradation of the turf or turf components. For example, the enzymes can comprise one or more enzymes selected from a group comprising Lipase, protease, amylase, hermicellulase, alkaline phosphatase, esterase, esterase-lipase, phosphoamidase, beta-galactosidase, and beta-glucosidase.

According to embodiments, the decomposition booster comprises dye-degrading bacteria, in particular azo dye-degrading bacteria. For example, the azo dye-degrading bacteria are composed of one or more bacterial strains selected from the group *Proteus* sp., *Pseudomonas* sp., and *Enterococcus* sp. A particularly useful bacterial strain for degrading azo dyes has been observed to be *Shewanella* decolorations, which may also be used as a decomposition booster.

Using decomposition boosters that also trigger the decomposition of the dyes in the turf may be advantageous, as the catabolism of said strains may ensure that decomposition of the dyes will not lead to toxic end products but rather will yield compost or minerals.

According to embodiments, the turf comprises artificial turf fibers comprising a compostable dye, in particular chlorophyll. Preferably, all dyes in the turf are compostable.

According to embodiments, the decomposition inhibitor comprises or consists of an antimicrobial substance. According to embodiments, the decomposition inhibitor is or comprises a substance other than a UV stabilizer.

The antimicrobial substance can be, for example, encapsulated with material that dissolves or disintegrates after the defined time period. Alternatively, the antimicrobial substance may be selectively contained in the surface of the turf fibers and other components, and may have a motility that causes the antimicrobial substance to diffuse, evaporate, or otherwise leave the turf until the predefined time period has elapsed.

For example, the antimicrobial substance can be a silver compound, an organoiodide compound, and/or an organobromide compound.

Organoiodides or organobromides that can be used in embodiments of the invention include bromides and iodides of alkyl, aryl, alkenyl, alkynyl, arylalkyl, arylalkenyl, or arylalkynyl groups. In addition, these compounds may be substituted by such organic functional groups as ethers, esters, amides, carbonates, carbonyls, acids, amines, or amine salts, provided that the functional groups do not interfere with the metabolic mechanism of releasing the iodide anion or bromide anion. Preferred compounds include compounds that can be prepared as particulate solid dispersions in water because they do not have a strong tendency toward aggregation and have sufficient motility to leave the turf after some months. For example, iodipamide ethyl ester exerts an intracellular antimicrobial effect. This is believed to be most likely due to the provision of iodide for the oxidative killing process. Thus, organoiodides or organobromides may act as broad-spectrum antimicrobials, since it is believed that the microbial mutation against this mechanism is highly unlikely and it is active against a broad range of microorganisms.

Using organoiodide or organobromide compounds may have the advantage that these compounds are less expensive and less toxic to the environment.

According to embodiments, the antimicrobial substance is a HALS-light stabilizer or triclosan or a substance having a porous surface structure adapted to impede the growth of microbes by adsorbing the microbes to the porous surface. Using a HALS light stabilizer may be advantageous, because the turf is protected not only against microbes, but also against UV light. It has been surprisingly observed that HALS light stabilizers also have anti-microbial effects.

According to embodiments, the antimicrobial substance has a porous surface structure and is adapted to impede the growth of microbes by adsorbing the microbes to the porous surface. In other words, the antimicrobial substance can be an adsorbent. Using an adsorbent as the antimicrobial substance may have the advantage that the amount of bacteria that can be adsorbed, and thus also the defined period of time when the turf actually starts to decompose, can be controlled in a fine-granular, easy, and cheap manner without using any toxic substances. By adding a particular type of adsorbent that has a particular porosity in a particular amount to the turf (e.g., the turf fibers, the carrier structure, if any, and the backing, if any), the total amount of bacteria that can be adsorbed and "deactivated" can be determined. Thus, by selecting a particular adsorbent in a particular amount, the predefined time period when the turf starts composting can be controlled. Moreover, many types of adsorbents are available that are nontoxic and comparatively cheap. According to embodiments, the amount of the antimicrobial substance is chosen such that the maximum microbe absorbance capacity of the antimicrobial substance is reached when the defined period of time has elapsed. Depending on the use site and material of the artificial or hybrid turf, the optimum amount of the antimicrobial substance may vary. Preferably, the porous substance is applied onto the turf after its installation and is not or at least not only provided as an integral part of the turf.

By performing some empirical tests with a particular type of turf at a representative use site, the optimum amount of the respective anti-microbial substance can be determined.

According to embodiments, the antimicrobial substance with the porous surface is either chitosan, zeolites, or activated carbon or a mixture thereof.

For example, chitosan, zeolites and activated carbon may act as decomposition inhibitors by adsorbing microorganisms which are capable of degrading artificial or hybrid turf components, thereby preventing the microorganisms to grow and reproduce. In general, the higher the concentration of the decomposition inhibitor, the longer the time period in which the artificial or hybrid turf does not show any sign of decay.

Chitosan is a linear polysaccharide composed of randomly distributed β-(1→4)-linked D-glucosamine (deacetylated unit) and N-acetyl-D-glucosamine (acetylated unit). It is made by treating the chitin shells of shrimp and other crustaceans with an alkaline substance such as sodium hydroxide. Chitosan has antimicrobial effects and can be used as a biopesticide, helping plants fight off fungal infections. Chitosan can be used as an adsorbent.

Activated carbon is a form of carbon comprising small, low-volume pores that increase the surface area available for adsorption or chemical reactions. Due to its high degree of microporosity, activated carbon is often used as an adsorbent. Just one gram of activated carbon has a surface area in excess of 3,000 $m^2$ as determined by gas adsorption.

According to embodiments, the method further comprises repeatedly applying the same type of decomposition inhibitor as is contained in the turf, or another type of decomposition inhibitor, during the defined period of time, and stopping the application of the decomposition inhibitor at the latest when the defined period of time has elapsed. For example, the decomposition inhibitor may be added to the water used for irrigation, or may be added to the fertilizer. It may also be applied separately from water or any fertilizer. Applying the decomposition inhibitor on the compostable or partially compostable turf one or more times before the defined period of time has elapsed may ensure that a premature start of the composting process is not possible.

According to embodiments, the decomposition booster is added selectively to one or more sub-areas of the turf, but not to other areas of the turf, thereby creating a desired hybrid turf or artificial turf pattern. This may be beneficial in various landscaping projects that comprise the design and implementation of complex patterns within the artificial turf or hybrid turf (e.g., some patterns or shapes that are too complex to be produced in a manufacturing hall). Hence, according to embodiments, the decomposition booster is added to specific sub-areas of the artificial turf or hybrid turf for designing and implementing complex patterns within the artificial turf or hybrid turf.

In a further aspect, the invention relates to a completely or partially compostable hybrid or artificial turf comprising a decomposition inhibitor.

According to embodiments, the decomposition inhibitor in the turf is adapted to lose its functionality or leave the turf until a defined period of time has elapsed.

According to embodiments, the turf is adapted to resist its decomposition in response to repeated exposure to water for at least the defined period of time. The turf is further adapted to be composted in response to the adding of a decomposition booster other than water to the turf.

Integrating a decomposition inhibitor into compostable artificial or hybrid turf may have the advantage that different types of turf can be made available that have varying defined minimum life expectancies guaranteed by the amount and type of the decomposition inhibitor contained therein, whereby the decomposition inhibitor has a temporally limited stability, availability, or effectiveness. The decomposition inhibitor may provide a kind of "minimum life expectancy" of the turf under defined conditions, for example, given a particular temperature and humidity range, and given a base material that basically consists of sand or aggregate. The adding of the decomposition booster ensures that once the decomposition inhibitor has become functionally inactive or has left the turf, the operator of the turf at the use site can freely decide when the composting process shall be started. When the inhibitor has become functionally inactive, or, at the latest, when the decomposition booster is added, the composting process starts. As is implicit from the definition of "composting," as soon as the composting process has been started, the turf rapidly degrades into compost and/or minerals.

According to embodiments, the decomposition inhibitor is a substance other than the polymer or polymer blend used for providing the synthetic (or reinforcing) fibers of the artificial (or hybrid) turf. This may be beneficial as it allows a better control of the time when the artificial turf or the hybrid turf support start to degrade. It allows increasing or decreasing the amount of the decomposition inhibitor depending on the use case scenario and climatic conditions without modifying the type of material used for creating the synthetic (or reinforcing) fibers.

According to embodiments, the decomposition booster is added in temporal proximity to the end of the predefined time period, e.g. within a time range starting 2 weeks before and two weeks after the end of the predefined time period. For example, the decomposition booster can be added in a time range two weeks before or two weeks after the time when the inhibitor has lost its function or has left the turf. For example, soil bacteria or enzymes acting as decomposition booster can be applied homogeneously on a field of artificial or hybrid turf two days before the inhibitor has lost its functionality or has left the turf. Then, the turf may be divided into pieces and mixed with soil acting as a further decomposition booster. The mixture of turf pieces, soil bacteria or enzymes and soil may repeatedly be irrigated and may rapidly turn into CO2 and compost.

According to embodiments, the decomposition inhibitor is an antimicrobial substance having a porous surface structure that is adapted to impede the growth of microbes by adsorbing the microbes to the porous surface. Preferably, the amount of the antimicrobial substance is chosen such that the maximum microbe absorbance capacity of the antimicrobial substance is reached when or after the defined period of time has elapsed. In addition, or alternatively, the porous antimicrobial substance is applied onto the hybrid or artificial turf after installation at the use site at least once and optionally one or more further times during the predefined time until the operator of the turf at the use site decides to replace the worn turf with new turf.

In a further aspect, the mixture comprises pieces of artificial or hybrid turf as described herein for embodiments of the invention and a decomposition booster. The decomposition booster can be soil in particular, or any other form of decomposition booster described for embodiments of the invention.

The term "artificial turf" as used herein is a manufactured surface of synthetic or natural fibers made to look like natural grass. It is often used in arenas for sports that were originally or are normally played on grass, but also on residential lawns and in commercial applications.

The term "hybrid turf" or "hybrid grass" as used herein is a product created by combining natural grass with manufactured, typically synthetic, materials, in particular reinforcing fibers. The manufactured reinforcing fibers incorporated into the natural grass surface and immediate root zone, protect the natural grass and therefore make the natural grass stronger and more resistant to damage. Moreover, the reinforcing fibers provide mechanical stability and support for the natural grass when the hybrid turf is planted and matured at a turf farm offsite, and then harvested into rolls of turf, transported, and laid at the use site (onsite). The reinforcing fibers can be synthetic (e.g PLA based), or can be plant fibers, such as jute, or sisal, or a combination thereof. The roots of the natural grass plants are allowed to intertwine with a mix of sand-soil and the reinforcing manufactured fibers as they grow.

The term "hybrid turf support" as used herein is the manufactured portion of hybrid turf. A hybrid turf support typically comprises synthetic fibers and a carrier structure, e.g. a carrier mesh. In some embodiments, the fibers are incorporated in the carrier structure and further fixed in the carrier structure by a backing material. Preferably, the hybrid turf support is completely or partially made of degradable, preferably compostable materials.

Different methods exist to insert synthetic, reinforcing fibers into the root zone, for example, injecting fibers 18 cm (typically) into the sand-soil with a specialized machine ("GrassMaster, SISGrass method"), mixing fibers and sand in an automated plant and installing it afterwards on the pitch ("Fibersand method"), or putting a mat with woven or tufted fibers on the surface, brushing in sand or sand mixes afterward to keep the fibers in an upright position, and, finally, seeding grass mixtures ("PlayMaster, Mixto, Xtra-Grass method"). The natural grass roots grow through the mat and thereby stabilize this hybrid system.

According to some embodiments, the hybrid turf is a combination of natural grass and artificial grass, where the artificial grass accounts for 3-5% of the playing surface. By adding artificial grass to the natural grass, the playing surface becomes more durable and consistent. In hybrid turf, the reinforcing fibers, also referred to as "artificial grass fibers", are attached to a backing via weaving or tufting to create a hybrid turf support with horizontal and vertical components. The hybrid turf support will overlay a sand-soil profile and will be infilled with a sand-soil growing medium prior to seeding or sprigging. Typically, the fiber length is 60 mm and the growing medium infill depth is 40 mm. The 20 mm of fiber remaining above the infill protects the natural grass, and in so doing creates the extra durability and consistency expected of hybrid turf. These parameters of laying and infilling are not dissimilar to how infilled artificial turf is installed, and many of the hybrid turf offerings have been developed by artificial turf companies. The hybrid turf support, which can consist of a backing and upright fibers, adds versatility to the user site, for example if required it can be removed and replaced to support the event schedule.

According to embodiments, the artificial turf and/or the hybrid turf comprise a backing that causes the fibers to adhere to the carrier and thereby increases tuft bind. Preferably, the backing is also compostable. In preferred embodiments of the hybrid turf, the backing is free of the decomposition inhibitor and thus may degrade faster than the fibers comprising the decomposition inhibitor. Thus, the backing of the hybrid turf may degrade before the defined time period has elapsed. Using a biodegradable backing that lacks the decomposition inhibitor may have the advantage of the backing providing mechanical hold but then rapidly degrading (e.g., in response to contact with water) to create voids for drainage, aeration, and root development, as described in US patent US006035577 and others.

Hybrid turf can be supplied in a turf roll that is prepared and grown off-site and then installed on-site as a "lay and play" solution. With this option, the fibers and backing of the hybrid turf support provide the turf roll with the necessary vertical and horizontal stability to guarantee immediate play. Traditionally, "thick-cut" soil-based turf rolls have been used for this purpose. However, without the stability provided by the hybrid turf support, they inherently lack consistency, which adversely impacts performance. The hybrid turf support's backing, if any, is preferably very open to ensure sufficient water drainage and root development.

Hybrid turf and artificial turf are commonly used for sports fields and have a grass-like look and feel, but they require less water, are more resistant to wear and tear, and have other advantageous properties over typical natural grass surfaces. Artificial turf fibers stand up to heavy use, such as in sports, and require no irrigation or trimming. In some regions, it may be difficult or impossible to grow natural grass due to the lack of sunlight or water.

Currently, hybrid turf supports and artificial turf systems vary greatly in their construction and application. Some hybrid turf products have similar fiber weight and backing weight to synthetic turf, hence they are ideal for a community training pitch and are designed for a minimum life expectancy of several years. Other hybrid turf and artificial turf products are designed for temporary installation, for example when hybrid turf is installed over synthetic turf for one football match. At the completion of the match, the hybrid turf may be disposed of or recovered and made ready for the next use. In this case, the hybrid turf may comprise only a UV stabilizer or only a very small amount of antimicrobial substances, while the underlying artificial turf may comprise an amount of decomposition inhibitor that is sufficient to prevent the composting of the artificial turf for several months or years.

Thus, when the hybrid turf and/or the artificial turf, according to embodiments of the invention, is disposed of, it is not necessary any more to separate materials (grass, sand, and plastic) for the recycling process. Rather, the grass-sand-plastic mixture may be composted as a whole, or only the sand component may be removed or reduced before the composting starts.

The terms "degradation" and "decomposition" are used herein as synonyms. The terms refer to the disintegration of materials by any kind of means, such as bacteria, UV light, material aging, acidic or basic liquids in which a particular material is completely or partially dissolved, or microorganisms.

The term "biodegradation" as used herein refers to the disintegration of materials by bacteria, fungi, or other biological means, such as other microorganisms or isolated enzymes (i.e., macromolecules that were at least originally produced by living organisms). Organic material can be degraded aerobically with oxygen, or anaerobically without oxygen. Biodegradable matter is generally organic material that serves as a nutrient for microorganisms and/or as a substrate of the enzymes.

The "defined period of time" as used herein is a time span. For example, the defined period of time can be specified starting from the installation of the artificial or hybrid turf at the use site ("onsite") or starting from the installation of the hybrid turf structure at the turf farm (offsite). According to embodiments, the defined period of time is a time period after which the decomposition inhibitor in the turf loses its decomposition-inhibiting functionality or leaves the turf. Preferably, the defined period of time is known by the organization or person having manufactured and/or installed the turf and is preferably communicated to the organization or person responsible for operating and maintaining the turf. Hence, in other words, the defined period of time is a time period after which the decomposition inhibitor in the turf is known to lose its decomposition-inhibiting functionality or is known to leave the turf. This may allow the turf owner or maintainer to deliberately add a decomposition booster in temporal proximity to the end of the defined time period, thereby significantly accelerating and controlling the composting of the turf at a particular, deliberately chosen moment in time. The length of the time period after which the decomposition inhibitor in the turf loses its decomposition-inhibiting functionality or leaves the turf may depend on the type and amount of decomposition inhibitor. For example, large amounts of the decomposition inhibitor and a large molecular weight or size of the inhibitor (which decrease its mobility) typically increase the length of the defined time period. Small amounts of the decomposition inhibitor and a small molecular weight or size of the inhibitor (which increase its mobility) typically decrease the length of the defined time period.

According to some embodiments, the defined period of time when the inhibitor leaves the turf or loses its function defines and determines the life expectancy of the turf. This means that the robustness of the turf against mechanical wear and tear and light-induced decay is not significantly longer than the time period during which the inhibitor protects the turf.

According to other embodiments, the robustness of the turf against mechanical wear and tear and light-induced decay is one or more month or even one or more years longer than the time period during which the inhibitor protects the turf. This results in a time period after the "defined time period" where the turf can still be used if it should still be in an acceptable state, but during which the turf can be composted rapidly at an arbitrarily selectable moment in time by adding the decomposition booster.

The term "decomposition inhibitor" as used herein is a substance that is adapted to inhibit or slow down a degradation process (e.g., a biodegradation process). For example, a decomposition inhibitor may block specific enzymes and may adsorb or kill bacteria and other microorganisms.

Accordingly, the term "decomposition booster" as used herein is a substance that is adapted to initiate, strengthen, or accelerate a degradation process (e.g., a biodegradation process). For example, a decomposition booster may consist of or comprise specific enzymes or microorganisms, may create microcracks in the turf material to ease penetration of the turf by bacteria, or may create a microenvironment that promotes the growth of microorganisms capable of degrading the turf material.

While "biodegrading an object" simply means that the object is consumed by microorganisms or enzymes, "composting an object" as used herein makes the specific demand that more than 90% of said object breaks down to $CO_2$ and water, and (optionally) also small organic particles passing through a 2-mm sieve ("compost"). A "compostable" material according to some embodiments of the invention is a material fulfilling the condition that more than 90% of its weight breaks down to CO2 and water, and (optionally) also small organic particles passing through a 2-mm sieve within 24 month, preferably within six months under composting conditions.

For example, a "compostable material" is material that is capable of undergoing biological decomposition in a compost site such that the material is not visually distinguishable and breaks down into carbon dioxide, water, inorganic compounds, and biomass at a rate consistent with that of known compostable materials. Jute, linen, hemp, polylactic acid, and sisal fibers are biodegradable as well as compostable. Typical degradation times of compostable materials under composting conditions range from two or three weeks to six months at a temperature of 15-25° C. if the material is constantly or repeatedly exposed to moisture. According to embodiments, the artificial turf or the hybrid turf support completely or partially consists of material that is in compliance with the ASTM D6400 standard for plastics designed to be aerobically composted. Preferably, the complete artificial turf or the complete hybrid turf support consists of material that is in compliance with the ASTM 6868 standard for end items that incorporate plastics and polymers and that are designed to be aerobically composted.

"Composting conditions" as used herein are conditions that support enzymatic activity of microorganisms (or their enzymes alone) to degrade organic matter. For example, when hybrid or artificial turf, according to embodiments of the invention, are newly installed on a use site, there may not exist "composting conditions": the dry sand or aggregate of the base layer and the decomposition inhibitor contained within the material of the artificial or hybrid turf, or contained within a coating of said turf, may not allow microbes to grow and secrete digestive enzymes. However, when conditions change (e.g., when the decomposition inhibitor is removed and a decomposition booster such as soil is applied to the turf), the turf may be composted.

The term "aggregate" as used herein is a mass formed by a collection of mixed-type natural and/or synthetic particles such as stone, sand, rubber granules or the like. Preferably, the aggregate allows (rain) water to leave the aggregate. As the aggregate layer is dry, it prevents soil bacteria to grow and thus has a comparatively low concentration of soil bacteria.

The term "synthetic fiber" as used herein refers to a fiber that is mainly or entirely made from synthetic materials, such as petrochemicals, but also bio-based raw materials, unlike those man-made fibers derived from such natural substances as cellulose or protein. In particular, a synthetic fiber can be a synthetic polymer fiber (e.g., a synthetic polyolefin fiber). A synthetic fiber can be made from PLA or other materials. The fibers used for generating artificial or hybrid turf can be synthetic fibers or "natural fibers," or a mixture of synthetic and natural fibers.

A "natural fiber" as used herein is typically a plant-derived fiber, such as sisal, hemp or jute fiber.

The term "sod farm" and "turf farm" or "sod grass farm" and "turf grass farm" as used herein refers to an agricultural company and farm that grows and sells turf.

The term "sod nursery" and "turf nursery" as used herein refers to a user and its nursery that grows but not necessarily sells turf.

The term "use site" and "venue" and "facility" as used herein refers to a location where hybrid or artificial turf is to be installed and used. For example, turf is used in sports fields, stadiums, lawns, landscapes, golf courses, and other sport and non-sport facilities.

According to some embodiments, the decomposition inhibitor is added to a polymer mixture or natural fiber substrate that is used for manufacturing the fibers incorporated into the artificial or hybrid turf. Alternatively, or in addition, the decomposition inhibitor is mixed into a coating liquid that is applied on the surface of the artificial or hybrid turf or its components and that slowly dissolves during the defined period of time or in response to the adding of the decomposition booster (e.g., an acid solution that destroys the coating). Thus, the coating with the decomposition inhibitor may ensure that the composting process does not start before the defined time period has elapsed.

Biodegradable artificial and hybrid turf can be used for many different use case scenarios (sports, events, landscaping, etc.) and in many different climatic environments. Hence, the required live expectancy and robustness against decay may differ from case to case. In the following, different use case scenarios are described.

One-Season Hybrid Turf

The decomposition inhibitor of one-season hybrid turf is chosen such that the compostable components of the hybrid turf support have a life expectancy of one year or less. For example, a multi-purpose stadium which hosts sport and non-sport activities may need the stability and durability to get through a football season despite difficult growing conditions (shade and poor air movement due to the architecture of the stadium, humidity, heat or cold due to the climate, etc.). Hence the life expectancy of the hybrid turf mat used for the football season in this case may be at least the length of a football season or slightly longer, e.g. six months, or 12 months if pregrown on a turf farm and installed as ready to play turf ("lay and play turf"). Each year after the end of the football season, the owner of the stadium may desire to replace the turf with a different type of turf that is more suited for the following concert season. Thus, the hybrid turf is exchanged twice per year. In this case, the old "football turf" should be degraded as soon as possible after its removal.

According to another example, the turf is replaced once per year, e.g. at the end of the football season or when the weather has become too cold for outside sport activities. At that occasion, the old turf is verticulated and a mixture of pieces of natural grass fibers, pieces of the hybrid turf support (e.g. pieces of PLA fibers, pieces of the degradable backing and/or carrier structure) and soil as the decomposition booster is generated. This mixture is then removed from the use site. For example, the mixture can be formed to a pile and irrigated for several month until composition of the degradable turf components has completed. Seasonal removal of worn hybrid turf may have the further advantage that weed that may start to grow and that is in competition to the growth of the natural grass is also removed. The life expectancy of the hybrid turf mat may be at least the length of a football season or slightly longer, e.g. 12 months, or 18 months if pregrown on a turf farm.

Hence, according to some embodiments, the defined time period is a time period of less than 18 month, in particular less than 12 month, e.g. a time period in a range of 4-18 month, e.g. 6-18 month or 4-12 month or 6-12 month. Preferably, the turf is a one-season hybrid turf.

Hybrid Turf Patches

In many sports, some particular regions within a sports field are subject to particularly heavy wear and tear, e.g. the area in front of football goals. According to embodiments, the hybrid turf is a piece of hybrid turf of a comparatively small size, e.g. less than 2 meters in length and width. The hybrid turf is selectively installed at the areas of increased wear and tear, while all other regions of the sport field consist of natural grass. Thus, sport field is provided that can be composted completely or almost completely, because it basically consists of natural grass and only one or more small patches of hybrid turf which are also completely or partially compostable.

According to embodiments, the defined time period is a time period of less than 24 month, in particular less than 18 month, e.g. a time period in a range of 4-24 month, e.g. 4-18 month or 6-18 month. Preferably, the turf is a patch of hybrid turf, e.g. a patch of less than 2 meters in length and width.

Multi-Season Hybrid Turf

According to other use case scenarios, the turf is designed for use in multiple seasons. Hence, the decomposition inhibitor of this type of hybrid turf is chosen such that the compostable components of the hybrid turf support have a life expectancy of two or more years, preferably more than 5 years.

According to embodiments, the defined time period is a time period of at least one year, preferably at least two years. The defined time period can be a time period of less than 10 years. Preferably, the defined time period has a length in a range of 2-10 years, e.g. 3-8 years, in particular 6 to 8 years. Preferably, the turf is multi-season hybrid turf or a multi-season artificial turf.

According to embodiments, the type and concentration of the decomposition inhibitor is chosen such that the defined time period is in the range of 4-18 month for one-season hybrid turf, in the range of 4-24 month for hybrid turf patches and in a range of 1-10 years for multi-season hybrid or artificial turf.

(Multi-Season) Artificial Turf

Artificial turf is typically used for many years. Hence, the decomposition inhibitor of this type of hybrid turf is chosen such that the compostable components of the artificial turf have a life expectancy of multiple years. Preferably, the artificial turf is installed on a water-permeable layer of sand or aggregate. In this case, the amount of decomposition inhibitor can be lower than in cases where the artificial turf is directly installed on soil, because the permeable sand or aggregate layer protects the artificial turf from soil bacteria.

Due to the wide variety of use case scenarios, stadium architectures and climatic conditions, the amount of decomposition inhibitor that ensures a sufficient life expectancy without unduly delaying the decomposition process is preferably determined empirically. Decomposition inhibitors and respective concentrations are given below for artificial or hybrid turf according to three alternative embodiments of the invention which have been observed to be applicable in many different countries and climate zones.

| Decomposition Inhibitor | Application of decomp. inhibitor | Amount of Decomposition inhibitor necessary for a life expectancy of the turf material of at least [ . . . ] | | |
|---|---|---|---|---|
| | | 3 Month | 6 Month | 12 Month |
| HALS-light stabilizer* | within fibers | 0.1% by weight of fibers | 0.4% by weight of fibers | 0.8% by weight of fibers |
| Triclosan (5-chlor-2-(2,4-dichlorphenoxy)-phenol) | within backing | — | 0.0005% by weight of backing | 0.001% by weight of backing |
| Chitosan | Applied on turf at installation | — | 5 g/m$^2$ | 10 g/m$^2$ |

*"HALS" means "hindered-amine-light-stabilizer". Preferably, Light Stabilizer UV-3529 (Chemical name: 1,6-Hexanediamine,N,N'-bis(2,2,6,6-tetramethyl-4-piperidinyl)-, Polymers with morpholine-2,4,6-trichloro-1,3,5-triazine, CAS. NO: 193098-40-7) is used as the decomposition inhibitor.

It has been surprisingly observed that HALS-light stabilizers, in particular UV-3529, have antimicrobial effects and thus can be used as decomposition inhibitors. Using HALS light stabilizers as degradation inhibitors may be particularly advantageous, as no additional UV-stabilizer is needed and production costs may be reduced. Preferably, the HALS light stabilizer are added to the fiber, backing and/or carrier structure of the artificial turf or hybrid turf support in an amount that is larger than needed for achieving sufficient UV stability.

In some embodiments, the artificial or hybrid turf also comprises a filler material which may also be biodegradable and comprise the decomposition inhibitor. For example, granules made of fibers derived from plant material, e.g. hemp fibers, can be used as compostable filler material. To prevent premature degradation, the filler compostable filler material may comprise e.g. an HALS light stabilizer and/or chitosan in the above specified amount.

HALS light stabilizers and triclosan are preferably provided as integral components of the fiber, filler, backing and/or carrier material of the turf. To the contrary, substances which act as decomposition inhibitors thanks to their porosity, e.g. chitosan, are preferably applied on top of the turf right after its installation. This may be beneficial as the comparatively high amounts of those types of substances could make the turf material, in particular the fiber material, brittle and less suited for use as a component of artificial turf or of a hybrid turf support.

BRIEF DESCRIPTION OF THE DRAWINGS

In the following, embodiments of the invention are explained in greater detail, by way of example only, making reference to the following drawings:

FIG. 1 is a flow chart of a method for controlling the decomposition of artificial or hybrid turf. For example, the owner or operator of a sport field that is used for playing soccer may intend to install hybrid turf in the use site. He or she may intend to use the installed hybrid turf for at least six months.

In step 102, artificial turf or hybrid turf comprising a decomposition inhibitor whose functionality or presence in the turf material is limited to a defined period of time is provided. For example, the operator may order a particular hybrid turf that comprises a particular amount and composition of a decomposition inhibitor that ensures that—although the hybrid turf may completely or partially consist of compostable material—the composting will not start until a defined time of e.g. five or six months has elapsed since the turf was installed at the use site.

The amount of decomposition inhibitor may depend on the particular use case scenario and the minimum life expectancy respectively required. For example, a typical football season has a duration of five month and the typical usage time of hybrid turf as a golf green is six month.

Figure 1:
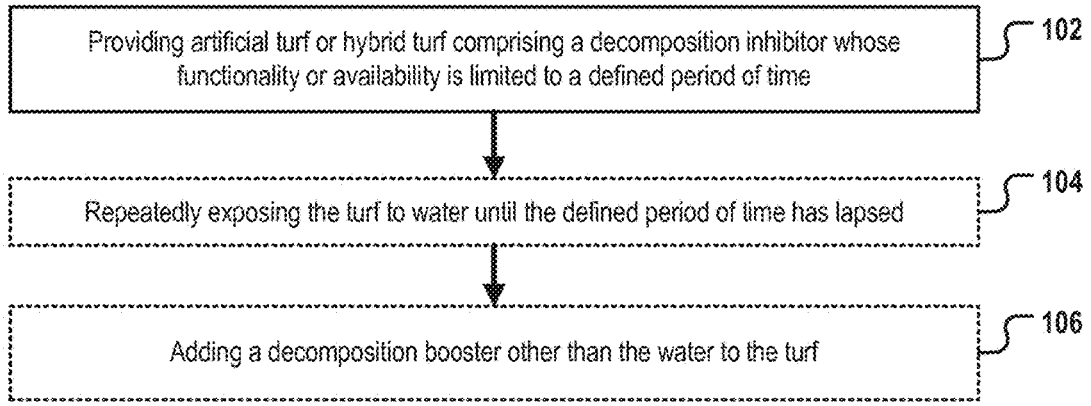
FIG. 1 is a flow chart of a method for controlling decomposition of artificial or hybrid turf.
Figure 2A:
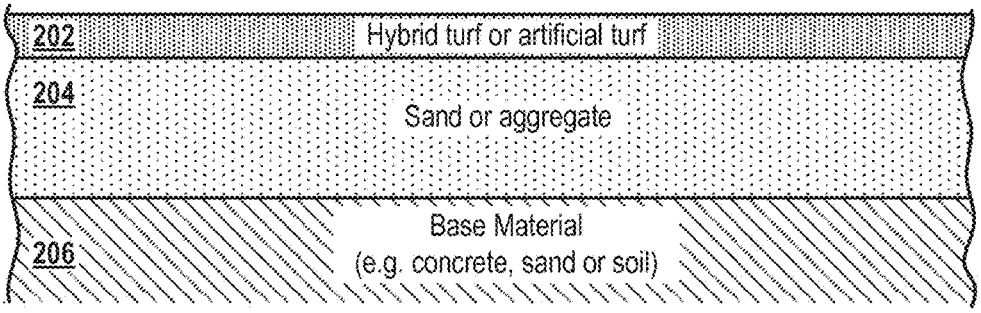
FIG. 2A depicts a piece of artificial or hybrid turf installed at a use site on top of a sand or aggregate layer.

For example, the ordered and delivered artificial or hybrid turf is installed at the use site as shown in FIG. 2A, which depicts a piece of artificial or hybrid turf installed at a use site on top of a sand layer.

During the defined time period of e.g. six months, the operator in step 104 may repeatedly expose the turf to water. Optionally (e.g., if it is hybrid turf), a fertilizer can be added to the turf. The water and/or the fertilizer may comprise a decomposition inhibitor (e.g., chitosan) that provides additional protection against biodegradation.

After the six months have passed, the hybrid turf will have lost its decomposition inhibitor, and/or the decomposition-inhibiting effect of said inhibitor, completely or almost completely. For example, bactericide substances may have diffused out of the turf and may be washed away by rainfalls and irrigation. Alternatively, the bactericide substance may be an adsorbent that is filled to its capacity with bacteria and other small particles. Thus, after six months, the turf may slowly begin to decay. In case the operator has decided to replace the worn turf, the operator may in addition add, in step 106, a decomposition booster, such as moist soil with soil bacteria, or enzymes, to the turf. As a consequence, the turf will decay rapidly and turn into $CO_2$, water, and minerals, and optionally compost within six further months starting from the adding of the decomposition booster.

The adding of the decomposition booster may not be necessary in every case. For example, in case the artificial turf or hybrid turf is installed on top of natural soil in a humid and warm climate, the composting of the turf may start immediately after the predefined time (here: six months) has elapsed and the decomposition inhibitor has lost its function. Thus, by using a compostable turf with a decomposition inhibitor and, optionally, with a decomposition booster after the defined period of time has elapsed, a very precise control over the composting process may be achieved.

FIG. 2A depicts a piece of artificial or hybrid turf 202 that has been installed at a use site on top of a sand or aggregate layer 204. The layer 204 may have, for example, a thickness of 1 cm or more. The hybrid turf may have, for example, a thickness of 3-15 cm. The sand or aggregate may be added on top of a base material 206 (e.g., concrete, soil, or a further layer of sand). The sand or aggregate layer 204 may ensure that rain water can leave the turf, that the total elasticity of the turf lawn is increased, that irregularities in the base layer are leveled out, and that the soil comprising soil bacteria does not come into contact with the turf. Thus, once the decomposition inhibitor has turned inactive, the composting of the turf may still not start, because sand lacks a sufficient amount of soil bacteria and moisture. However, by supplementing the turf with a decomposition booster, the composting of the turf may be triggered at a defined time that suits the needs of the sport field operator.

Figure 2B:
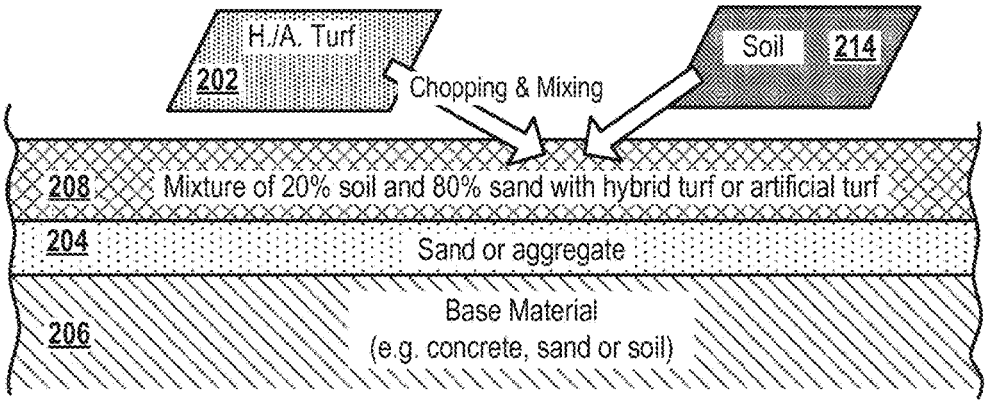
FIG. 2B depicts a piece of artificial or hybrid turf installed at a use site on top of a sand or aggregate layer.

FIG. 2B depicts the pavement structure generated by chopping the turf 202 into pieces and mixing the turf pieces with soil 214 to generate a layer 208 comprising at least 10% soil, preferably 20% or more preferably more than 50% soil. The soil 214 can be derived from a different region and transported to the use site as indicated in FIG. 2B. Alternatively, the sand/turf mixture may be transported to a composting facility where this mixture is supplemented with soil 214 and is maintained under composting conditions, in particular a humid and warm environment.

Figure 2C:
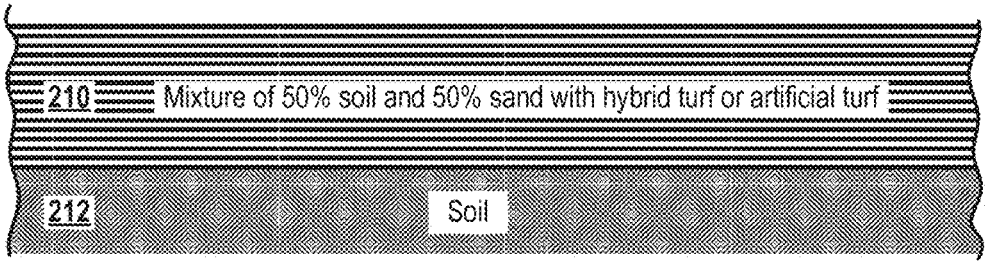
FIG. 2C depicts a mixture comprising pieces of chopped artificial or hybrid turf and soil.

FIG. 2C depicts a situation where the chopped pieces of the turf 202 depicted in FIG. 2A are—together with the sand/aggregate layer 204—ploughed into the base layer 212 consisting of soil to a defined depth. The turf is chopped into pieces and is ploughed together with the sand layer 204 into the base layer 206 consisting of soil. Thereby, the turf material comes into contact with the soil bacteria, and the composting of the turf pieces starts. The ploughing depth determines the fraction of soil contained in the mixture 210 of sand, turf pieces, and soil generated during the ploughing process.

Figure 3:
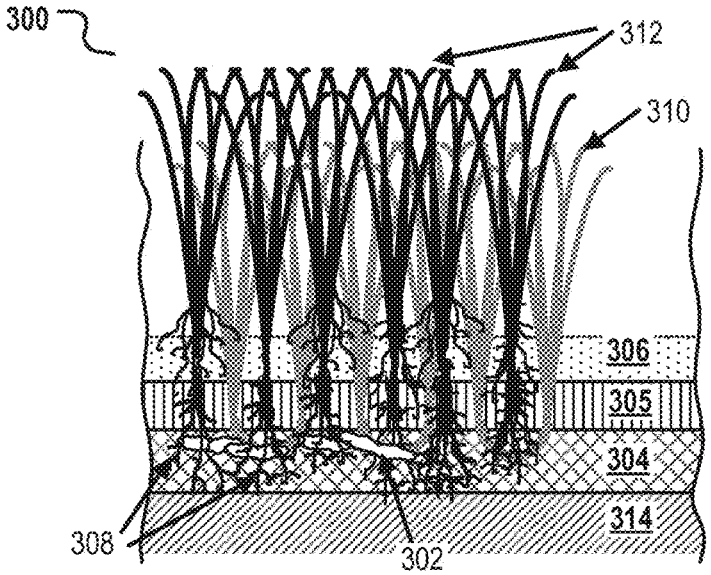
FIG. 3 depicts a piece of hybrid turf.

FIG. 3 depicts a piece of hybrid turf 300 having been installed at the use site. The base layer 314 at the use site may be, for example, clay or any other form of soil comprising soil bacteria. On top of the base layer is a layer of sand or aggregate 304. The hybrid turf installed on top of the sand or aggregate layer comprises a compostable carrier structure 305 (e.g., a jute mesh) and compostable fibers 310 (e.g. of polylactic acid) incorporated into the carrier structure by, for example, tufting, knitting, or weaving. The fibers can be, for example, monofilaments or bundles of multiple monofilaments. Each monofilament can be generated, for example, in an extrusion process or by means of a slit film process. In order to firmly fix the fibers 310 in the carrier at least until the hybrid turf is transported from the sod farm to the use site, a backing 302 is applied to the lower side of the carrier structure 305 such that at least some portions of the fibers become embedded in the backing. When the liquid backing solidifies, the fibers are mechanically fixed in the carrier. The roots 308 of the plants may reach the sand and even the base layer 214. In FIG. 3, the natural grass fibers 312 are depicted in black, and the artificial turf fibers 310 in grey. The natural grass blades intermix with the artificial turf fibers and form a piece of hybrid turf 300. When the natural grass has reached its desired length, the backing 302, which is preferably free of the decomposition inhibitor, has preferably already disintegrated into small fragments and may even have been largely or completely degraded without a negative impact on the stability of the hybrid turf. An optional fill layer 306 supports the roots and crowns of the natural grass plants, and the grass blades of the natural grass plants, as well as a large portion of the artificial turf fibers 310, extend above the fill layer to create a hybrid grass surface that faithfully reproduces a natural grass surface. The support "carries" the natural grass plants and the fill layer and stabilizes it during transport from the sod farm to the use site and in the early phase of growing the natural grass.

According to embodiments, the backing 302 may comprise agar-agar, starch, or a heterogeneous latex mixture whose various latex types have different swelling capabilities. Thus, when the backing 302 is in contact with water, it is dissolved or mechanically disrupted. As a consequence, the roots have sufficient space to grow without clogging the openings of the carrier mesh 305 and thus without making the hybrid turf support structure water-impermeable.

According to embodiments, the hybrid turf is generated such that the liquid backing is applied to the lower side of the carrier structure 305. The carrier structure can be a multilayer structure, for example, a combination of a jute mesh and a PLA mesh. The backing is applied such that more than 10% but less than 70%, and preferentially less than 50%, of the lower side of the whole carrier structure 305 is sealed by the backing. According to embodiments, the backing of artificial turf is also generated so that it does not completely seal the carrier structure for the artificial turf fibers. This may prevent an accumulation of water, which could cause the roots of the natural grass plants to rot (in the case of hybrid turf), or could result in a premature degradation of the turf due to prolonged contact with water (in both the cases of hybrid turf and artificial turf).

According to some embodiments, the liquid backing is made of a degradable material (e.g., a biodegradable material). For example, the liquid backing can be made of natural latex or starch-based latex: the liquid backing can be a copolymer of starch with styrene/butadiene latex. Alternatively, the biodegradable backing can be made of natural rubber.

According to other embodiments, the degradable backing essentially consists of or comprises (e.g., by at least 30% or more) a biodegradable material. For example, the biodegradable backing can comprise a copolymer of starch with styrene-butadiene latex. The generation of said copolymers is described, for example, in US20130276245A1, but embodiments of this invention differ from the method described in US20130276245A1 at least in that no pigments are used. For example, the starch-latex copolymer backing can be made from a mixture comprising starch and monomeric components. The monomeric components in the mixture that are copolymerized comprise:

i. styrene or a substituted styrene;
ii. an acrylate and/or methacrylate;
iii. optionally: one or more further ethylenically unsaturated monomers.

For example, 5 to 40% by weight of the mixture may consist of starch, and 50 to 95%, preferably 60 to 95%, by weight of the mixture may consist of the monomeric components. The starch is biodegradable and also will allow the roots to penetrate the carrier structure mesh cells that are fully or partially sealed by the starch-latex copolymer backing after some weeks or months.

Figure 4:
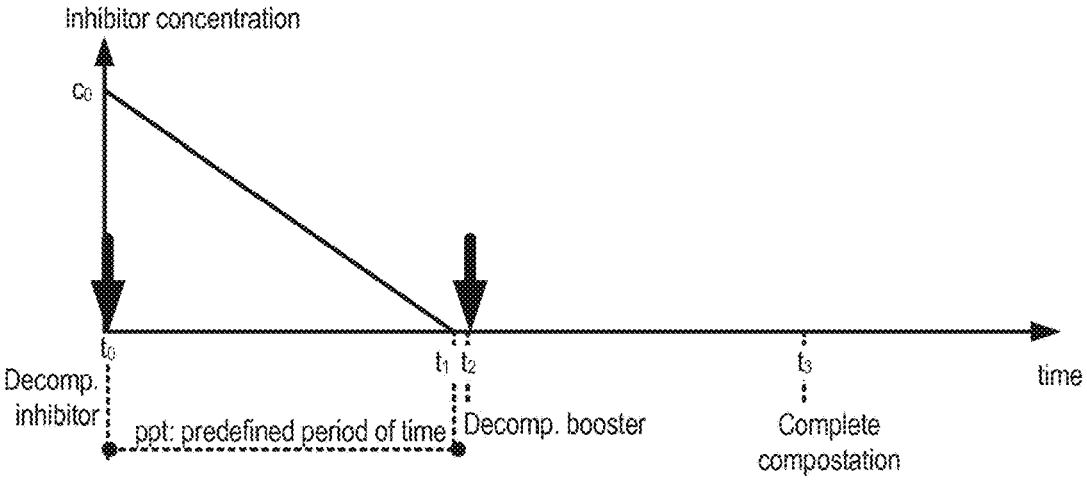
FIG. 4 shows a plot illustrating the provision of the inhibitor and the booster.

FIG. 4 shows a plot which illustrates the provision of the inhibitor and the booster. At time to, an artificial turf or hybrid turf comprising a particular, initial concentration of the decomposition inhibitor is provided. For example, at time to, an artificial turf or hybrid turf may be installed at a use site, whereby the material of the turf comprises a defined concentration co of the decomposition inhibitor. Alternatively, at time to, an artificial turf or hybrid turf may be installed at a use site, whereby the material of the turf does not comprise the decomposition inhibitor. However, immediately or several days after the installation of the turf, a defined concentration co of the decomposition inhibitor is applied on the turf, e.g. as a component of the water used for irrigating the turf. The concentration of the inhibitor is chosen such that during a defined period of time, e.g. 6 month or 12 month, the inhibitor continuously loses its function or leafs the turf. For example, the inhibitor can be a porous material whose surface binds bacteria until the binding capacity of the porous material is exhausted. Alternatively, the inhibitor can be material that gradually decays or that is gradually washed out of the turf. The nature and concentration of the decomposition inhibitor in the turf is chosen such that it loses its decomposition-inhibiting functionality or leaves the turf until the defined period of time ppt has elapsed at $t_1$. This may ensure that after the time t1 a rapid composting process can be triggered by adding a decomposition booster at time $t_2$. Preferably, the decomposition booster is added in close temporal proximity to time $t_1$. Thus, $t_2$ and $t_1$ may typically be identical or very similar. This may ensure that the turf remains stable until time $t_1$ is reached, but may degrade rapidly when the decomposition booster is added, e.g. when the turf is mechanically disassembled and mixed with the decomposition booster, e.g. soil.

LIST OF REFERENCE NUMERALS

100-106 steps
202 hybrid or artificial turf
204 sand or aggregate layer
206 base material layer
208 sand/soil/turf pieces mixture
210 sand/soil/turf pieces mixture
212 soil
214 soil
300 hybrid turf
302 backing (disrupted)
304 sand or aggregate layer
306 filler material
308 roots
310 artificial turf fibers
312 natural grass blades
314 soil layer/base layer

The invention claimed is:

1. A hybrid turf comprising:
compostable synthetic fibers,
a compostable carrier structure, and
a decomposition inhibitor having a decomposition-inhibiting functionality reducing decomposition of the compostable synthetic fibers and of the compostable carrier structure by reducing the growth and reproduction of microorganisms capable of decaying the compostable synthetic fibers and the compostable carrier structure before expiration of a defined period of time, wherein the decomposition inhibitor in the turf has a decomposition-inhibiting functionality expiring at or after the defined period of time has elapsed, or wherein the decomposition inhibitor is configured to leave the turf until the defined period of time has elapsed.

2. The turf of claim 1, wherein the turf is configured to resist decomposition in response to repeated exposure to water for at least the defined period of time, and/or is configured to be composted in response to the adding of a decomposition booster other than water to the turf.

3. The turf of claim 1, wherein the defined time period being in the range of 4-18 month for one-season hybrid turf, in the range of 4-24 month for hybrid turf patches and in a range of 1-10 years for multi-season hybrid.

4. The turf of claim 1, wherein the decomposition inhibitor comprises an antimicrobial agent.

5. The turf of claim 1, wherein the decomposition inhibitor is at least one of a silver compound, an organoiodide compound, and an organobromide compound, including bromides and iodides of alkyl, aryl, alkenyl, alkynyl, arylalkyl, arylalkenyl, or arylalkynyl groups.

6. The turf of claim 1, wherein the compostable synthetic fibers comprise polylactic acid, the compostable carrier mesh is made of fibers derived from plant material including sisal, jute, linen, coconut or hemp; and the turf further includes a backing of natural latex, or starch-based latex, or agar-agar.

7. A method of controlling decomposition of a hybrid turf installation, the method comprising:

providing a hybrid turf installation including a compostable turf comprising compostable synthetic fibers and a compostable carrier structure, adding a decomposition inhibitor on the turf in water used to irrigate the turf or in a separate liquid solution or in powder, wherein the decomposition inhibitor has a decomposition-inhibiting functionality reducing decomposition of the compostable turf by reducing the growth and reproduction of microorganisms capable of decaying the compostable synthetic fibers and the compostable carrier structure, wherein the decomposition-inhibiting functionality of the decomposition inhibitor is designed to expire after a defined period of time has elapsed, or wherein the decomposition inhibitor is configured to leave the turf until the defined period of time has elapsed, and adding a decomposition booster other than water to the turf in temporal proximity to the time when the defined period of time has elapsed, the decomposition booster being configured to compost the turf.

8. The method of claim 7, wherein the decomposition booster is added within two weeks before and two weeks after the time when the defined period of time has elapsed, and wherein the decomposition inhibitor comprises at least one of a silver compound, an organoiodide compound, and an organobromide compound, including bromides and iodides of alkyl, aryl, alkenyl, alkynyl, arylalkyl, arylalkenyl, or arylalkynyl groups.

9. The method of claim 8, further comprising:

dividing the turf into pieces;

wherein the adding of the decomposition booster comprises mixing the decomposition booster with the pieces of the turf or applying the decomposition booster on the turf before it is divided, and wherein the decomposition booster comprises an acidic solution having a pH value below 6.

10. The method of claim 8, wherein the turf is compostable in response to the adding of the decomposition booster, but is not compostable without the presence of the decomposition booster, and wherein the decomposition booster further comprises soil; or one or more strains of isolated soil bacteria including bacteria isolated from compost, hydrocarbon-degrading bacteria, one or more bacterial strains selected from the group comprising *Pseudomonas* sp., *Mucobacterium* sp., *Corynebacterium* sp., *Aeromonas* sp., *Rhodococcus* sp., and *Bacillus* sp, and enzymes configured for biodegradation of the turf or turf components.

11. The method of claim 7, wherein the compostable synthetic fibers are made of polylactic acid and the compostable carrier structure is a compostable carrier mesh made of fibers derived from plant material including sisal, jute, linen, coconut or hemp; and the turf further includes a backing of natural latex, or starch-based latex, or agar-agar.

12. The method of claim 7, wherein the compostable synthetic fibers comprise a compostable dye, in particular chlorophyll.

13. The method of claim 7, wherein the decomposition inhibitor comprises an antimicrobial substance.

14. The method of claim 13, wherein the antimicrobial substance is:

a HALS-light stabilizer or triclosan or a substance having a porous surface structure configured to impede the growth of microbes by adsorbing the microbes to the porous surface.

15. The method of claim 13, wherein the antimicrobial substance is chitosan, zeolite or activated carbon.

16. The method of claim 7, wherein the type and concentration of the decomposition inhibitor is chosen such that the defined time period is in the range of 4-18 month for one-season hybrid turf, in the range of 4-24 month for hybrid turf patches and in a range of 1-10 years for multi-season hybrid.

17. The method of claim 7, further comprising:

repeating the adding of the decomposition inhibitor at least twice during the defined period of time and using the same or different decomposition inhibitor in each repetition, and stopping the adding of the decomposition inhibitor at the latest when the defined period of time has elapsed.

18. The method of claim 7, wherein the decomposition booster is added selectively to one or more sub-areas of the turf but not to other areas of the turf, thereby creating a desired hybrid turf.

* * * * *